US009738436B2

(12) United States Patent
Sell

(10) Patent No.: US 9,738,436 B2
(45) Date of Patent: Aug. 22, 2017

(54) AEROSOL ACTUATORS

(75) Inventor: Steven A. Sell, Belton, MO (US)

(73) Assignee: SILGAN DISPENSING SYSTEMS CORPORATION, Grandview, MO (US)

( * ) Notice: Subject to any disclaimer, the term of this patent is extended or adjusted under 35 U.S.C. 154(b) by 683 days.

(21) Appl. No.: 13/818,124

(22) PCT Filed: Aug. 23, 2011

(86) PCT No.: PCT/US2011/048816

§ 371 (c)(1),
(2), (4) Date: Feb. 21, 2013

(87) PCT Pub. No.: WO2012/027373

PCT Pub. Date: Mar. 1, 2012

(65) Prior Publication Data

US 2013/0153607 A1 Jun. 20, 2013

Related U.S. Application Data

(60) Provisional application No. 61/376,007, filed on Aug. 23, 2010, provisional application No. 61/430,727, filed on Jan. 7, 2011, provisional application No. 61/481,795, filed on May 3, 2011.

(51) Int. Cl.

| | |
|---|---|
| ***B65D 83/16*** | (2006.01) |
| ***B65D 83/22*** | (2006.01) |
| ***B65D 83/20*** | (2006.01) |

(52) U.S. Cl.

CPC ..... *B65D 83/22* (2013.01); *B65D 83/206* (2013.01)

(58) Field of Classification Search

CPC ..... B65D 83/206; B65D 83/22

USPC ..... 222/402.21, 402.15, 402.11, 153.01, 222/153.02, 153.05, 153.06, 153.07, 222/402.13, 153.11, 153.13, 321.8; 239/526

See application file for complete search history.

(56) References Cited

U.S. PATENT DOCUMENTS

| | | | | |
|---|---|---|---|---|
| 3,254,803 | A * | 6/1966 | Meshberg | 222/182 |
| 3,580,432 | A * | 5/1971 | Brooks | 222/402.13 |
| 3,696,977 | A * | 10/1972 | Davenport et al. | 222/561 |
| 3,765,573 | A * | 10/1973 | Landsman | 222/182 |
| 4,187,963 | A * | 2/1980 | Mascia | 222/402.13 |
| 5,875,934 | A * | 3/1999 | Miller et al. | 222/183 |
| 6,021,927 | A * | 2/2000 | Nomiyama et al. | 222/402.14 |
| 2007/0034653 | A1 | 2/2007 | Strand | |
| 2009/0283609 | A1 * | 11/2009 | Strand | 239/333 |
| 2011/0132936 | A1 * | 6/2011 | Weng | 222/402.13 |

(Continued)

FOREIGN PATENT DOCUMENTS

| | | |
|---|---|---|
| JP | 2009 214917 | 9/2009 |
| WO | WO2007/149459 | 12/2007 |

OTHER PUBLICATIONS

International Search Report for PCT/US2011/048816 dated Apr. 24, 2012.

*Primary Examiner* — Charles P Cheyney
(74) *Attorney, Agent, or Firm* — Barlow, Josephs & Holmes, Ltd.

(57) ABSTRACT

An aerosol actuator which may be connected to a container to form an aerosol delivery system or package wherein the aerosol actuator includes two parts: a base and a trigger, the trigger including a integrated cap for the base, trigger, spring or living hinge, manifold and orifice.

14 Claims, 20 Drawing Sheets

(56) References Cited

U.S. PATENT DOCUMENTS

| | | | | |
|---|---|---|---|---|
| 2011/0220685 | A1* | 9/2011 | Lind et al. | 222/402.11 |
| 2011/0233235 | A1* | 9/2011 | Adams et al. | 222/402.13 |

* cited by examiner

AEROSOL ACTUATORS

CROSS-REFERENCE TO RELATED APPLICATIONS

This application claims the benefit of the following U.S. Provisional Application No. 61/376,007, entitled "AEROSOL TRIGGER SPRAYER AND METHODS FOR MAKING THE SAME," filed 23 Aug. 2010; 61/430,727, entitled "AEROSOL ACTUATORS," filed 7 Jan. 2011; and 61/481,795, entitled "AEROSOL ACTUATORS," filed 3 May 2011; and incorporates each of the same herein by reference in their entireties.

BACKGROUND OF THE INVENTION

Field of the Invention

The present invention relates to aerosol sprayer devices and more particularly to simplified aerosol actuators.

State of the Art

Spray devices are well known and are used to deliver a variety of products. For example, finger pumps and trigger sprayers may be used to deliver a fluid from a container onto a surface or into a volume of space. Similarly, aerosol sprayers are used to spray an aerosolized product onto a surface or into a volume of space. Many different types of spray devices are known.

Aerosol spray devices typically include a pushbutton type spray device containing an orifice and a connection to a valve which is in turn connected to a container of product from which the aerosol product is dispensed. Actuation of the pushbutton releases a quantity of product from the aerosol container through the valve and the pushbutton. More recently, aerosol spray devices have been modified to look more like trigger sprayers and such devices may include a trigger attached to, or in communication with, a manifold which is connected to the valve of an aerosol container. However, connection of a manifold of a trigger actuated aerosol spry device to an aerosol valve can be difficult and leakage during assembly or actuation may occur.

Actuation of the trigger may release product from the aerosol container through the valve, into the manifold, and out an orifice of the trigger spray device. In many instances, the costs of trigger actuated aerosol sprayers are higher than those of pushbutton-type valves due to the increased piece parts and complexity of such devices. In addition, use of pushbutton-type aerosol systems may lead to finger fatigue which may be undesirable.

While the aerosol pushbutton actuators and trigger actuators are usable, new, alternative, or improved methods for delivering or actuating a spray from aerosol containers or other containers are desirable. In addition, a reduction in costs is also desirable, especially in the case of trigger actuated aerosol sprayers and spray devices.

BRIEF SUMMARY OF THE INVENTION

According to some embodiments of the invention, an aerosol trigger actuator may include at least two parts: a trigger and a body. The trigger may be attached to the body and a portion of the trigger may flex to contact a portion of the body which moves a manifold integrated with the body. Movement of a portion of the trigger may actuate the manifold such that product in a container attached to the aerosol trigger actuator may be released.

In some embodiments of the invention, one or more live or living hinges integrated with a trigger and a body may facilitate the movement of a manifold integrated with the body. The living hinges may also facilitate repeated actuation of a trigger such that the aerosol trigger actuator may be attached to a container containing a product and used to evacuate the contents of the container.

According to other embodiments of the invention, an aerosol trigger actuator may include at least two parts: a base and a trigger. A trigger may be shaped to form a cap for the base and may include a manifold integrally molded with the trigger. A portion of the trigger or cap integrated with the trigger may be configured to flex or allow movement of the trigger with respect to the base when assembled. That portion may also be configured to return the trigger to a rest position when not actuated.

In some embodiments of the invention, a trigger and cap combination may include one or more springs or live hinges which may facilitate movement of a trigger portion and movement of a manifold integrally formed with the trigger and cap combination. The one or more springs or living hinges may allow a trigger portion of the trigger and cap combination to flex or be moved from a non-actuated position to a position of actuation.

According to certain embodiments of the invention, a spring or living hinge may be configured to provide a desired actuation force for a trigger portion of a trigger or return force for the trigger portion following actuation.

According to still other embodiments of the invention, a valve guide may be connected to or integral with the base of an aerosol actuator. In still other embodiments of the invention, a valve guide may be formed with a manifold or other portion of a cap to facilitate assembly of an actuator with a aerosol valve and can.

BRIEF DESCRIPTION OF THE DRAWINGS

While the specification concludes with claims particularly pointing out and distinctly claiming particular embodiments of the present invention, various embodiments of the invention can be more readily understood and appreciated by one of ordinary skill in the art from the following descriptions of various embodiments of the invention when read in conjunction with the accompanying drawings in which:

DETAILED DESCRIPTION OF THE INVENTION

According to embodiments of the invention, an aerosol actuator (or trigger sprayer) may include two or more parts. According to embodiments of the invention, an aerosol actuator may include a trigger integrally molded with a manifold. The trigger may also serve as a cap for a body of the aerosol actuator. In some embodiments, the trigger and cap may include an integrally formed spring or an integrally formed living hinge. The spring or living hinge may provide a resistant force when the trigger is actuated and a force sufficient to disengage a manifold from actuation of a valve when forces applied to the trigger during actuation are removed or reduced. In some embodiments, a spring or a living hinge may include geometries which may improve the function of the spring or living hinge.

Figure 1:
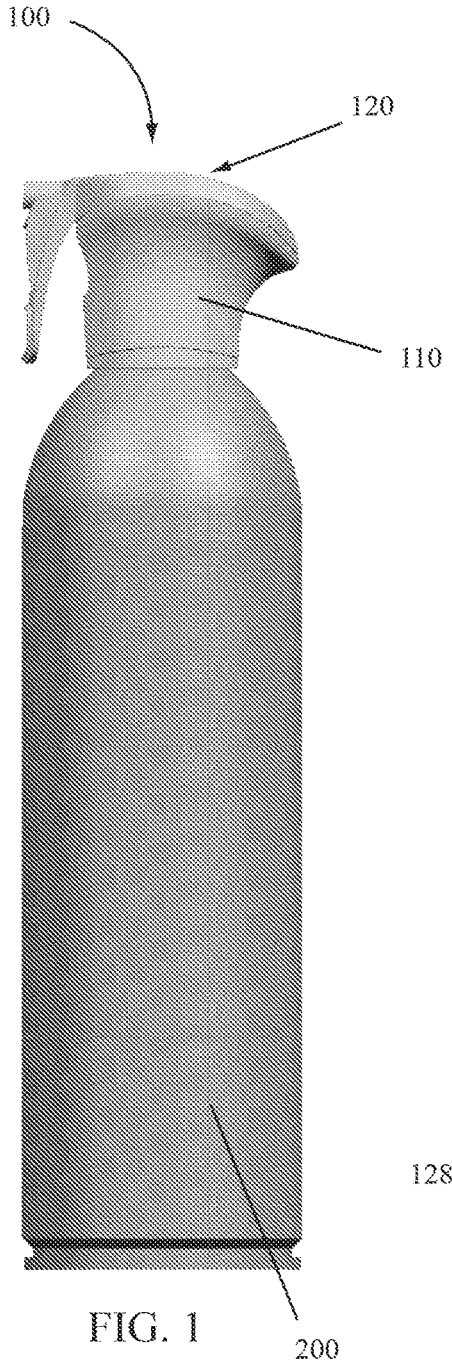
FIG. 1 illustrates an aerosol package including an aerosol actuator according to various embodiments of the invention.
Figure 2:
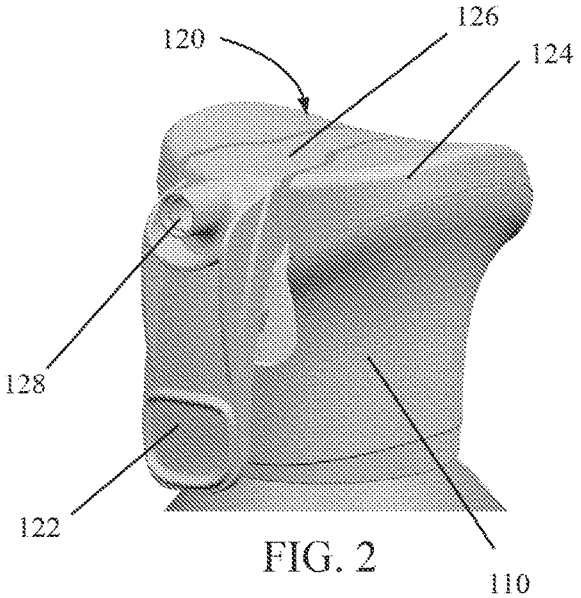
FIG. 2 illustrates a perspective view of an aerosol actuator according to various embodiments of the invention.
Figure 3:
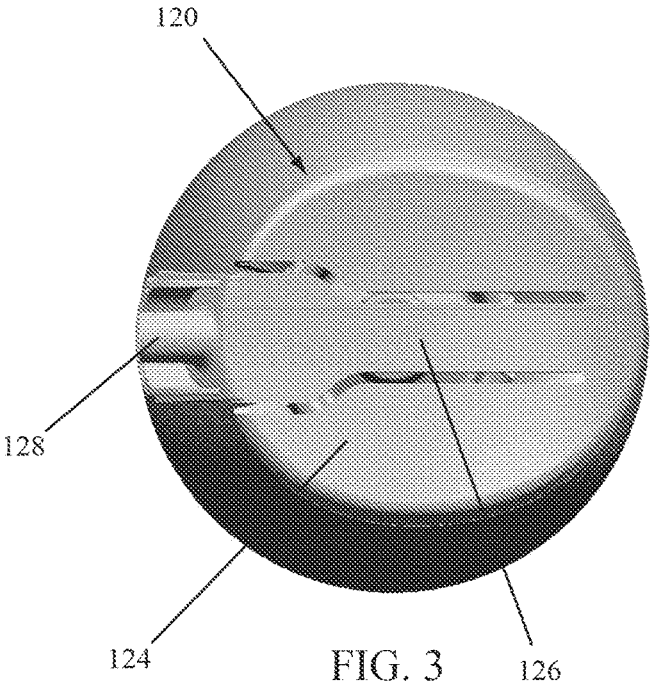
FIG. 3 illustrates a top-down view of an aerosol actuator according to various embodiments of the invention.

An aerosol actuator 100 according to certain embodiments of the invention is illustrated in FIGS. 1 through 3. As illustrated, an aerosol actuator 100 may be attached to or fitted to a container 200. An aerosol actuator 100 may include a base 110 and a trigger 120. The trigger 120 may include a trigger portion 122, a cap portion 124, and a spring 126 or live hinge portion. A trigger 120 may also include an orifice 128 or discharge port which may also be fitted with an orifice cup.

Figure 4:
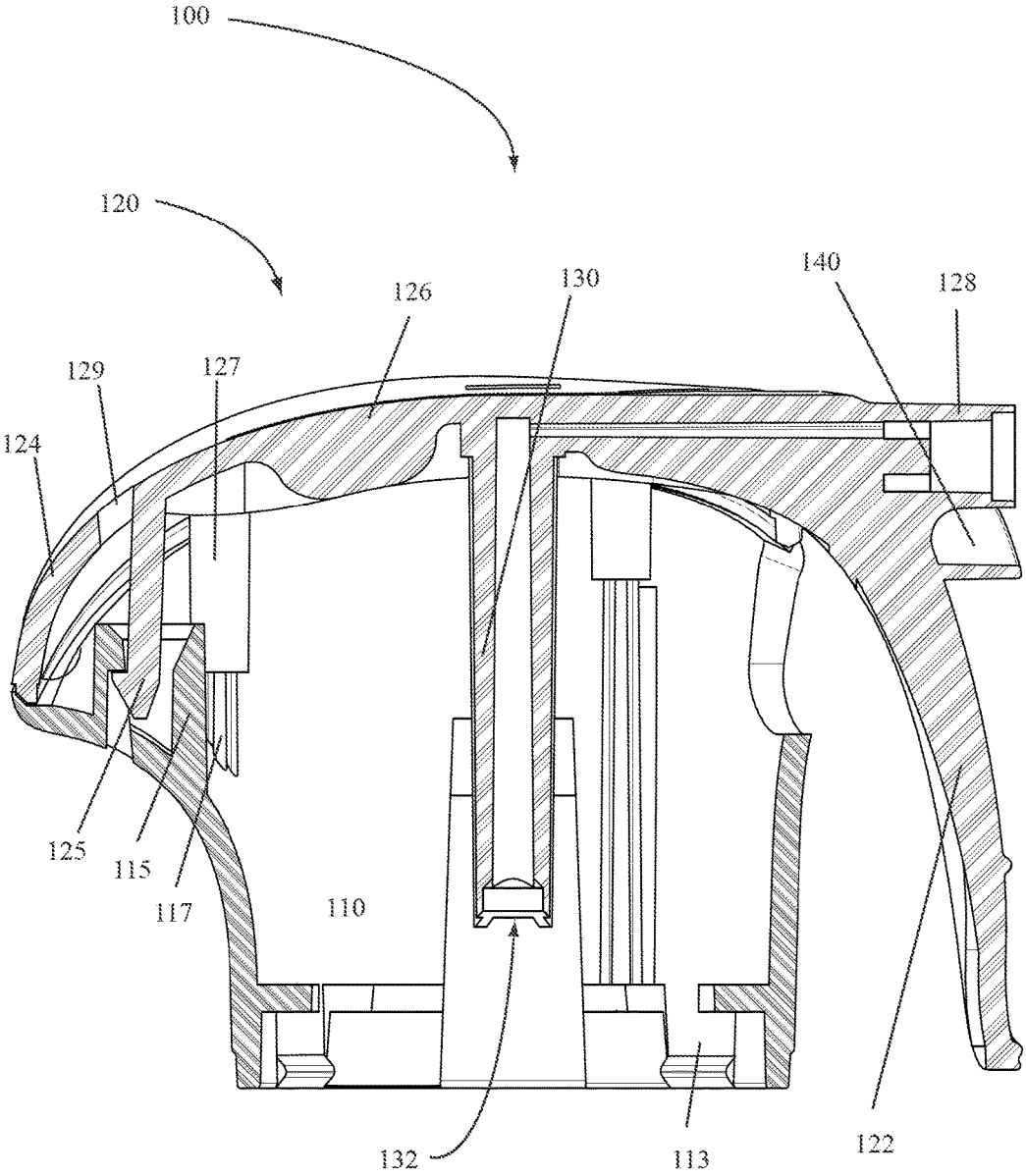
FIG. 4 illustrates a cross-sectional view of an aerosol actuator according to various embodiments of the invention.
Figure 5:
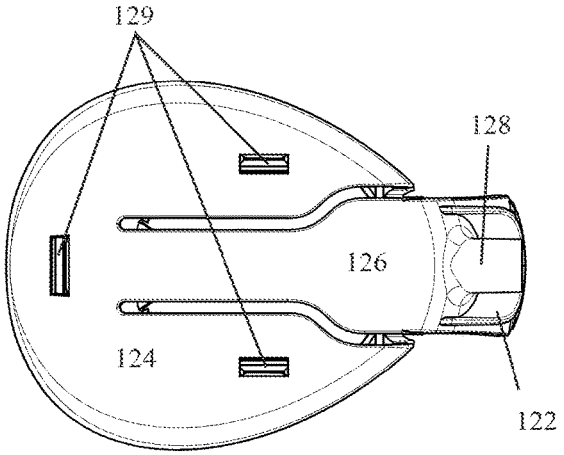
FIG. 5 illustrates a top-down view of an aerosol actuator according to various embodiments of the invention.
Figure 6:
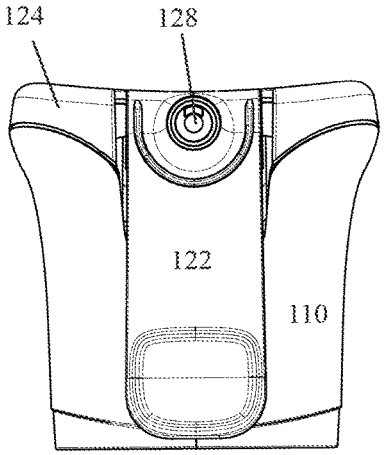
FIG. 6 illustrates a front view of an aerosol actuator according to various embodiments of the invention.
Figure 7:
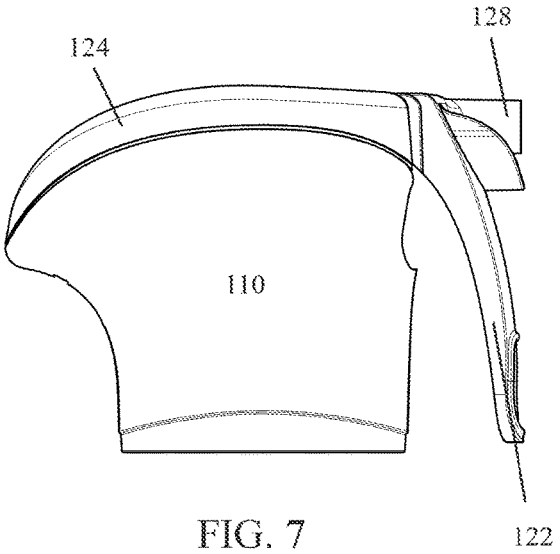
FIG. 7 illustrates a side view of an aerosol actuator according to various embodiments of the invention.
Figure 8:
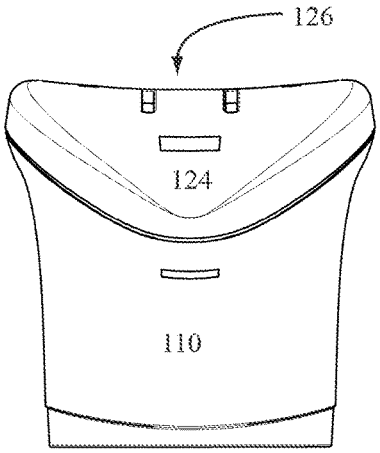
FIG. 8 illustrates a rear view of an aerosol actuator according to various embodiments of the invention.
Figure 9:
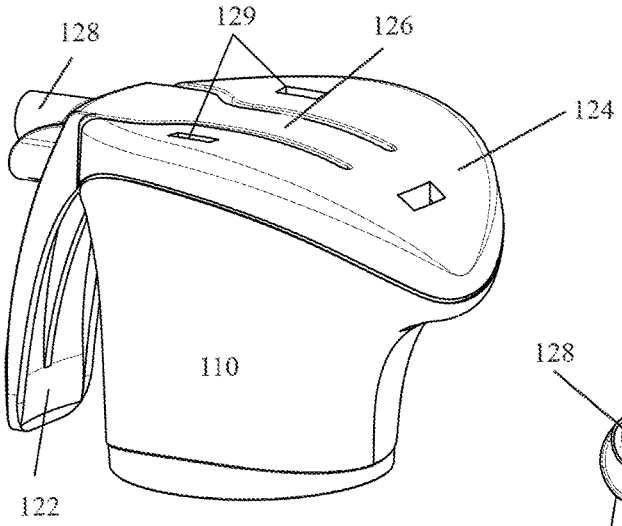
FIG. 9 illustrates a rear-perspective view of an aerosol actuator according to various embodiments of the invention.
Figure 10:
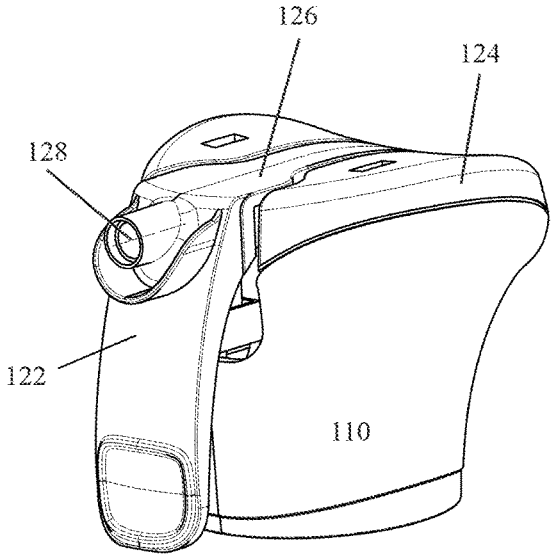
FIG. 10 illustrates a front-perspective view of an aerosol actuator according to various embodiments of the invention.

A cross-sectional view of an aerosol actuator 100 according to certain embodiments of the invention is illustrated in FIG. 4. An aerosol actuator 100 may include a base 110 attached to, or fitted with, a trigger 120 as illustrated in FIG. 4. A trigger 120 may include a trigger portion 122, a cap portion 124, one or more springs 126, an orifice 128, and a manifold 130.

According to certain embodiments of the invention, the trigger portion 122 may include a projection, lever, or other feature to which force may be applied to move the manifold 130 integrally formed with the trigger 120. In some embodiments, a trigger portion 122 may include finger supports, finger pads, reference indicia, or other features as desired.

A cap 124 portion of a trigger 120 may be formed or shaped to mate with, attach to, or otherwise fit with a base 110. In some embodiments, a cap 124 may include one or more post receptacles 127 or posts which may mate with or attach to one or more posts 117 or post receptacles of a base 110. The posts 117 and post receptacles 127 may provide support to the aerosol actuator 100, may be used to assemble a base 110 with a trigger 120, or may be used for any other desired function. A cap 124 may also include one or more snap attachments 125 which may mate with one or more snap fitments 115 in a base 110. The snap attachments 125 may be shaped, formed, or otherwise configured such that they may be press fit, snapped, or otherwise inserted into a snap fitment 115 to secure a trigger 120 to a base 110 as illustrated in FIG. 4. While the snap attachments 125 and snap fitments 115 may hold a trigger 120 on a base 110, they may be configured to allow disassembly of a trigger 120 and a base 110 as well.

In some embodiments, a cap portion 124 may also provide support to a spring 126 or living hinge which may be formed in the cap portion 124. For example, as illustrated in FIG. 3, a spring 126 may be defined in the cap portion 124 by cuts in the cap portion 124. A spring 126 may be connected to or be an extension of the trigger portion 122 as illustrated in the various embodiments.

According to embodiments of the invention, a spring 126 or living hinge may be formed in any desired shape or configuration. Some shapes which may be used with embodiments of the invention are illustrated in the Figures. However, it is understood that other shapes and cuts defining a spring 126 may exist in a trigger 120. For example, the shape of a spring 126 according to various embodiments of the invention may be designed based on the material being used to mold or form the trigger 120 such that desired resilient forces can be achieved against an actuation pull of a trigger portion 122 and the return of a trigger portion 122 following actuation.

In various embodiments of the invention, a spring 126 is integrally formed with a trigger portion 122 and is connected to a cap portion 124 of the trigger 120. The spring 126 may also be part of, or connected to, an integrally formed manifold 130.

An orifice 128 in a trigger 120 may be formed as desired. An orifice 128 may be shaped or configured to accept an orifice cup. An orifice 128 may also include spin mechanics integrated with the orifice 128 to provide spin, swirl, or other characteristics to a fluid or product exiting the orifice 128 or an orifice cup in the orifice 128.

In some embodiments of the invention, a portion of the cap portion 124 may include one or more cap depressions 129. A cap depression 129 may provide access to an opposite side of the cap portion 124 during molding to facilitate formation of a feature on one side of the trigger 120. For example, a cap depression 129 illustrated in FIG. 4 is positioned near a snap attachment 125 and may be formed by a slide or other feature in a mold during fabrication or manufacture of the trigger 120. The cap depression 129 may allow a portion of a mold to form such features as a snap attachment 125 with the trigger 120 in a cost effective manner.

A base 110 according to embodiments of the invention may be shaped or configured to mate with a trigger 120 as desired. A base 110 may be shaped to be ergonomically favored by a particular user. A base 110 may also include one or more container connections 113 which may fasten to, snap against, or otherwise mate with a container 200 to hold an aerosol actuator 100 onto a container 200 as illustrated in FIG. 1.

According to embodiments of the invention, a manifold 130 may be integrally formed with the trigger portion 122, spring 126, or cap portion 124 of the trigger 120. A manifold 130 may be configured to mate with a valve fixed to an aerosol container 200 and may move as a trigger portion 122 of an aerosol actuator 100 is actuated. As a manifold 130 moves, it may open the valve, allowing a product from a container 200 to flow through a product flow path 132 in the manifold 130 and out an orifice 128. A manifold 130 may be shaped or otherwise configured to mate with a valve in a particular way to reduce leakage or to improve actuation of the valve.

As illustrated in FIG. 4, a trigger 120 according to certain embodiments of the invention may also include a cup 140 which may catch fluid drooling or leaking from an orifice 128. The cup 140 may prevent product leaving the orifice 128 from contacting a user's fingers positioned on a trigger portion 122 during operation or holding of an aerosol actuator 100. While various embodiments of the invention are illustrated as having a cup 140, a cup 140 need not be present.

FIGS. 5 through 10 illustrate various views of an aerosol actuator 100 such as that illustrated in FIG. 4 according to certain embodiments of the invention.

Figure 11:
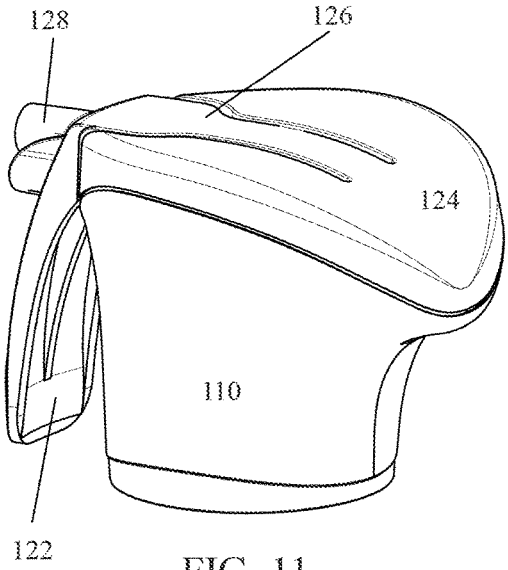
FIG. 11 illustrates a rear-perspective view of an aerosol actuator according to various embodiments of the invention.
Figure 12:
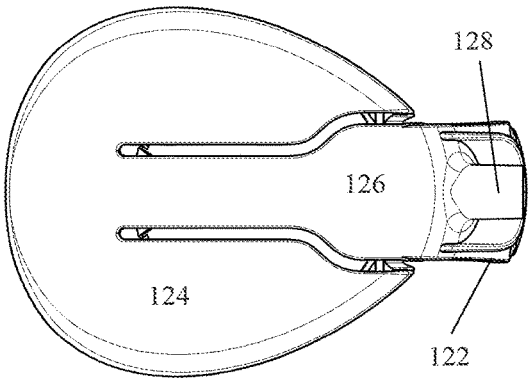
FIG. 12 illustrates a top-down view of an aerosol actuator according to various embodiments of the invention.

FIGS. 11 and 12 illustrate perspective and top-down views of an aerosol actuator 100 according to other embodiments of the invention. As illustrated, the aerosol actuator 100 illustrated in FIGS. 11 and 12 does not include cap depressions 129 as in some other embodiments. The presence or absence of cap depressions 129 may be elected based upon cost and aesthetic desires. For example, in some instances it may be preferred to produce a trigger 120 wherein the cap depressions 129 do not exist in order to provide an aesthetic look having a relatively smooth or uninterrupted cap portion 124 surface. In other instances cost may be the driving factor and the presence of the cap depressions 129 may result from the mold action used to manufacture a trigger 120. The use of or inclusion of cap depressions 129 may result as a function of tooling or mold action. If the aesthetic appearance of the cap depressions 129 is not a factor, the options for making tooling which utilizes and creates cap depressions 129 during molding to reduce costs may be beneficial.

Figure 13:
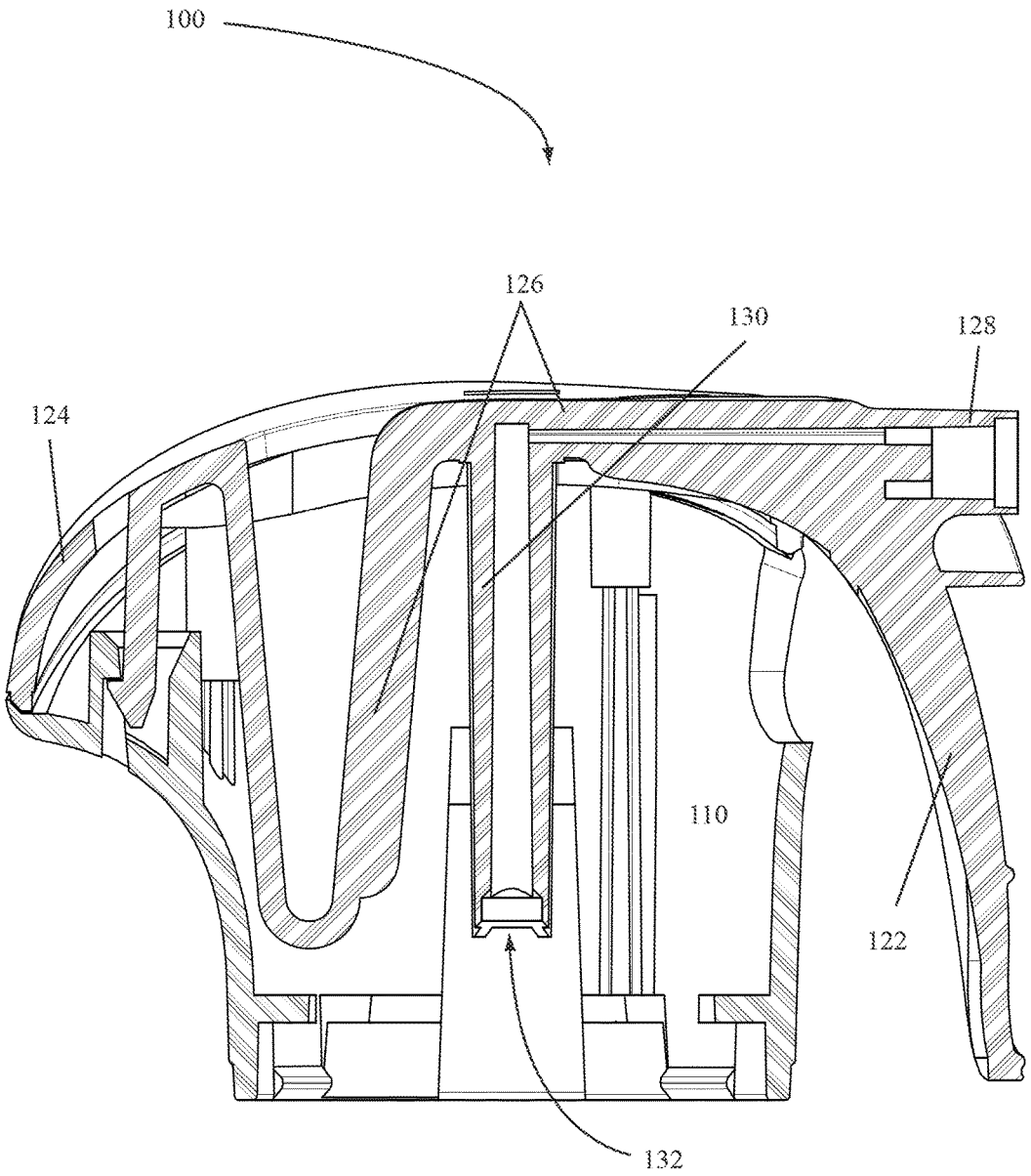
FIG. 13 illustrates a cross-sectional view of an aerosol actuator according to various embodiments of the invention.
Figure 14:
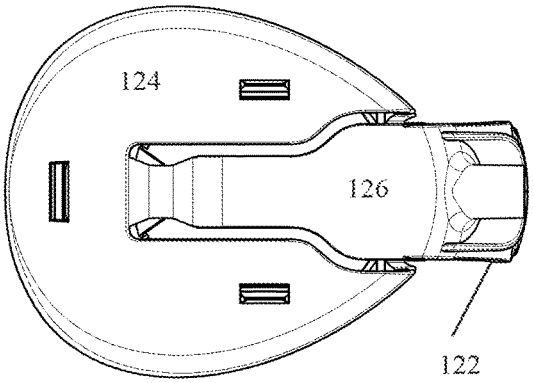
FIG. 14 illustrates a top-down view of an aerosol actuator according to various embodiments of the invention.
Figure 15:
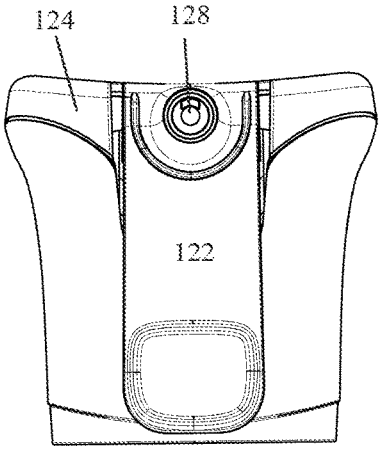
FIG. 15 illustrates a front view of an aerosol actuator according to various embodiments of the invention.
Figure 16:
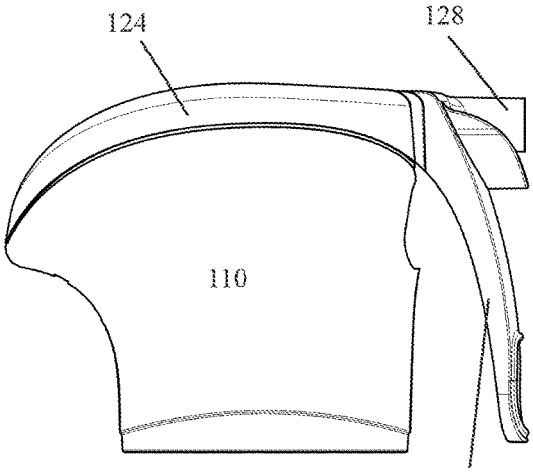
FIG. 16 illustrates a side view of an aerosol actuator according to various embodiments of the invention.
Figure 17:
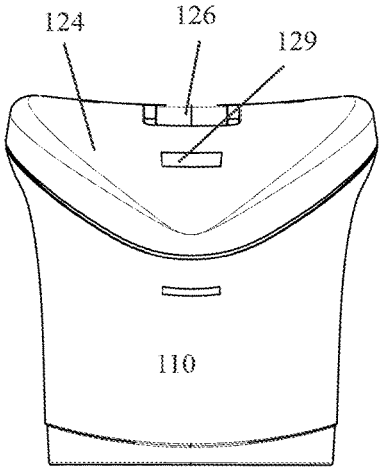
FIG. 17 illustrates a rear view of an aerosol actuator according to various embodiments of the invention.
Figure 18:
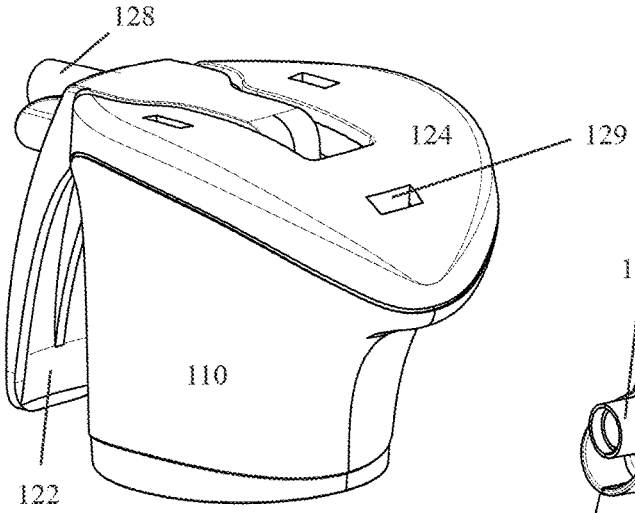
FIG. 18 illustrates a rear-perspective view of an aerosol actuator according to various embodiments of the invention.
Figure 19:
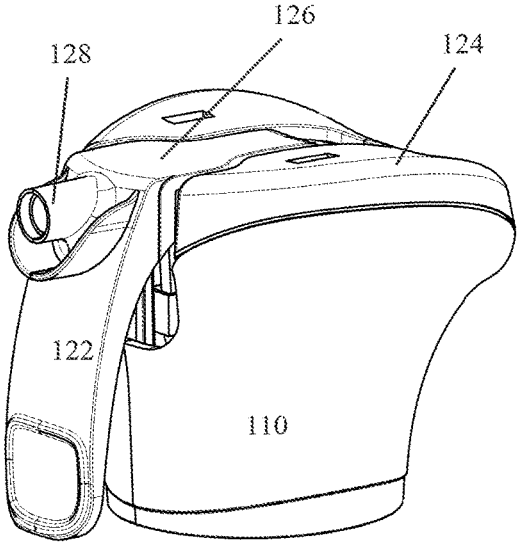
FIG. 19 illustrates a front-perspective view of an aerosol actuator according to various embodiments of the invention.

An aerosol actuator 100 according to other embodiments of the invention is illustrated in FIG. 13. As illustrated, the spring 126 or live hinge of the aerosol actuator 100 may extend into an interior space formed by the base 110 and trigger 120. The spring 126 configuration and shape may be adjusted or customized to provide a desired return force for the trigger portion 122 following actuation. The spring 126 configuration and shape may also be adjusted or customized to provide a desired actuation force, requiring a user to apply a certain threshold of force against a trigger portion 122 before an integrated manifold 130 will move a sufficient distance to open a valve to which it is in communication.

An aerosol actuator 100 as illustrated in FIG. 13 may include other features as desired.

Figure 20:
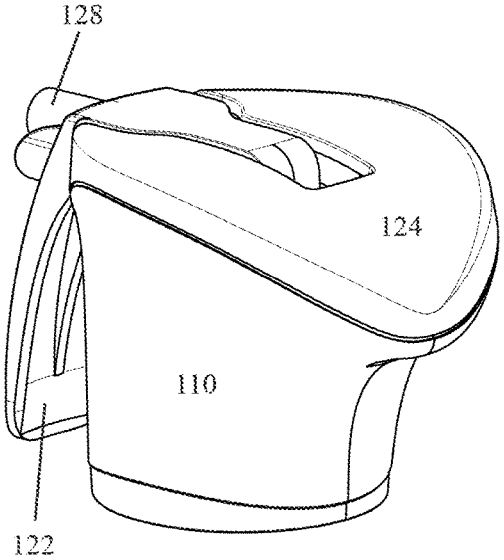
FIG. 20 illustrates a rear-perspective view of an aerosol actuator according to various embodiments of the invention.
Figure 21:
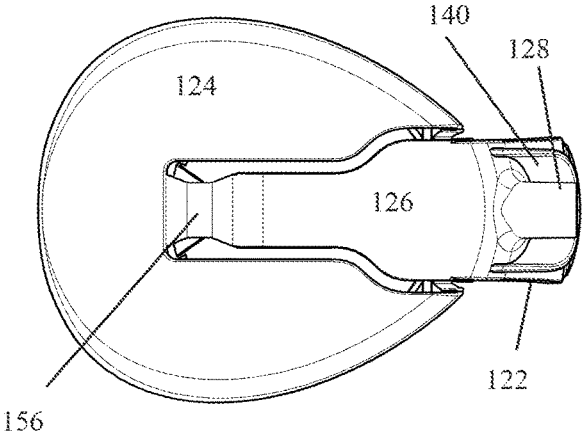
FIG. 21 illustrates a top-down view of an aerosol actuator according to various embodiments of the invention.

FIGS. 14 through 19 illustrate different views of an aerosol actuator 100 such as that illustrated in FIG. 13. FIGS. 20 and 21 illustrate an alternative embodiment in which cap depressions 129 are not present in the cap portion 124 of the trigger 120.

Figure 22:
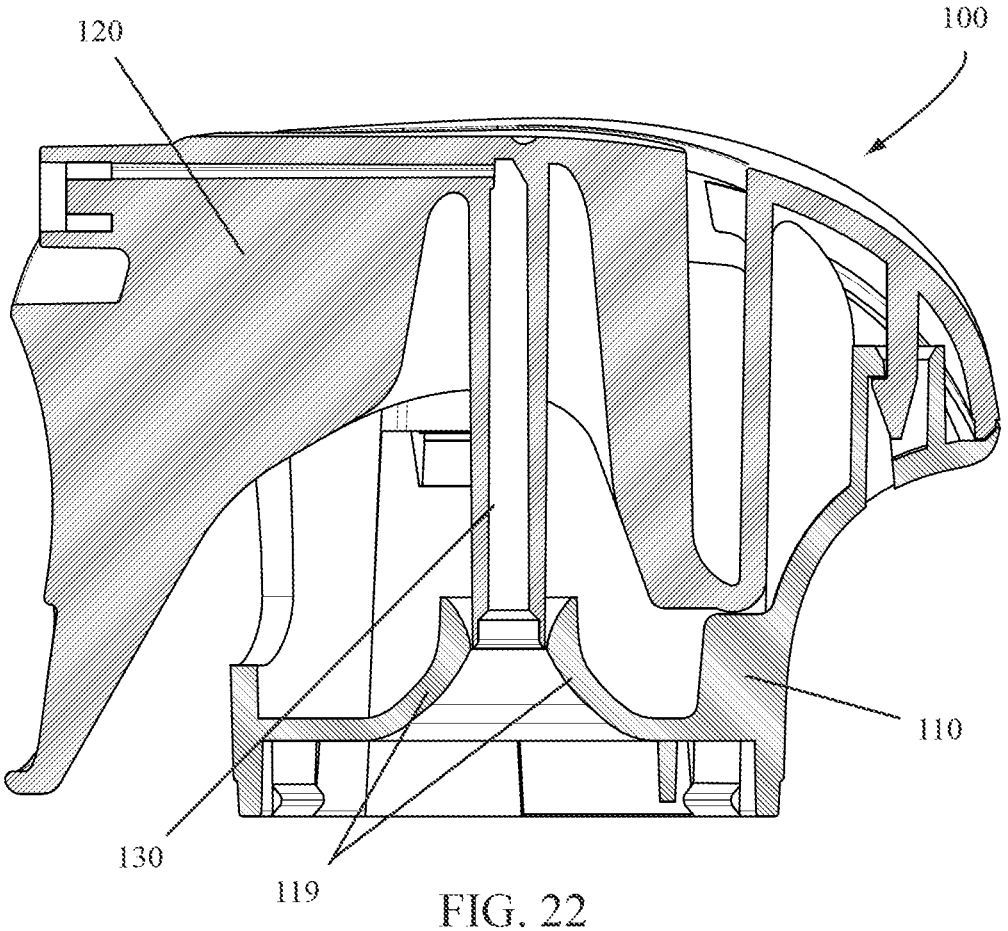
FIG. 22 illustrates a cross-sectional view of an aerosol actuator according to various embodiments of the invention.
Figure 23:
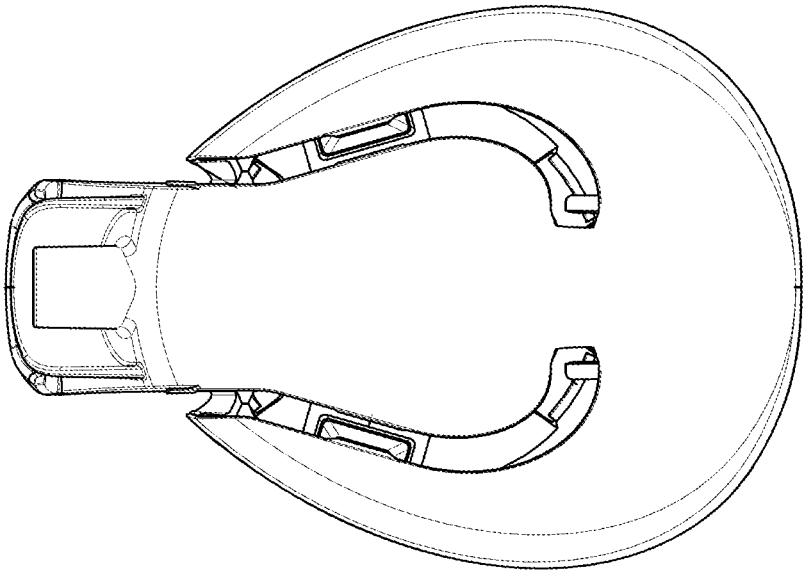
FIG. 23 illustrates a top-down view of an aerosol actuator according to various embodiments of the invention.
Figure 24:
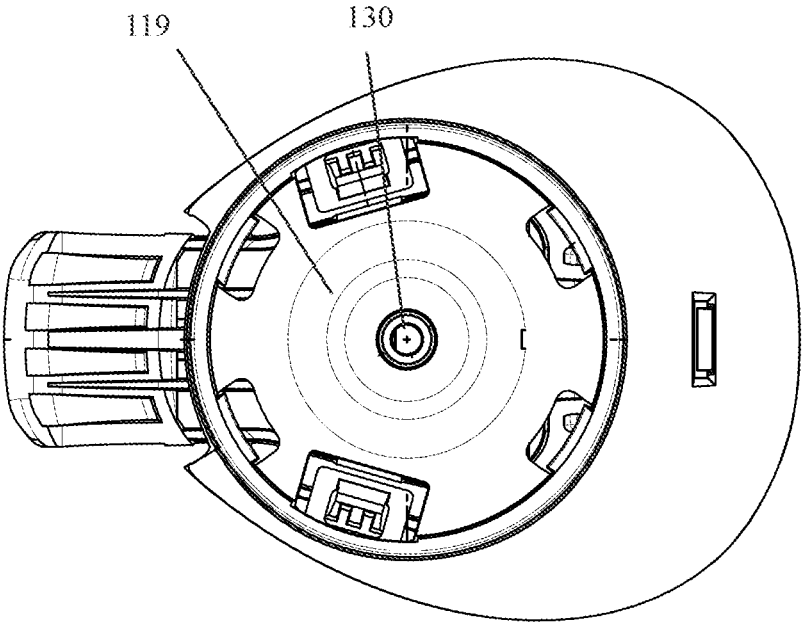
FIG. 24 illustrates a bottom-up view of an aerosol actuator according to various embodiments of the invention.
Figure 25:
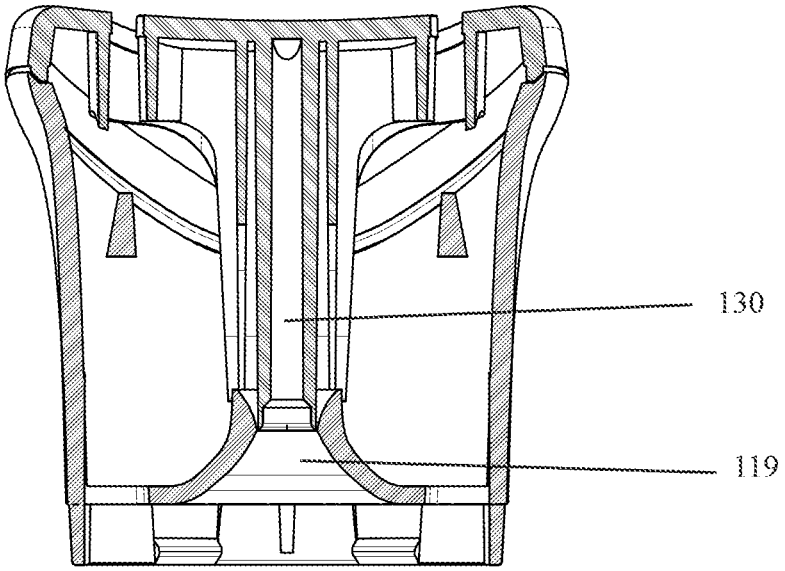
FIG. 25 illustrates a cross-sectional front view of an aerosol actuator according to various embodiments of the invention.
Figure 26:
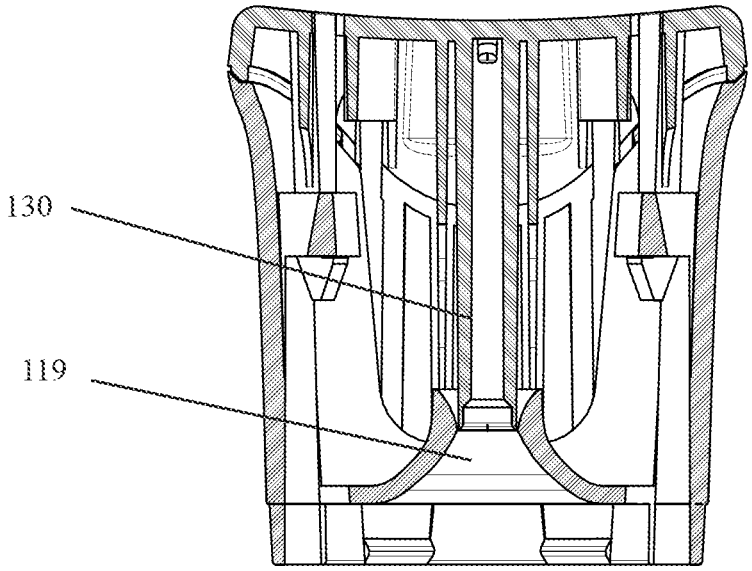
FIG. 26 illustrates a cross-sectional rear view of an aerosol actuator according to various embodiments of the invention.

An aerosol actuator 100 according to other embodiments of the invention is illustrated in FIGS. 22 through 26. A cross-sectional view of an aerosol actuator 100 according to certain embodiments of the invention is illustrated in FIG. 22. As illustrated, the aerosol actuator 100 may include a base 110 and a trigger 120. A spring 126 or live hinge similar to that illustrated in FIG. 13 may be used with such embodiments of the invention. In other embodiments, a spring 126 or live hinge as illustrated in FIG. 4 may be used.

Figure 27:
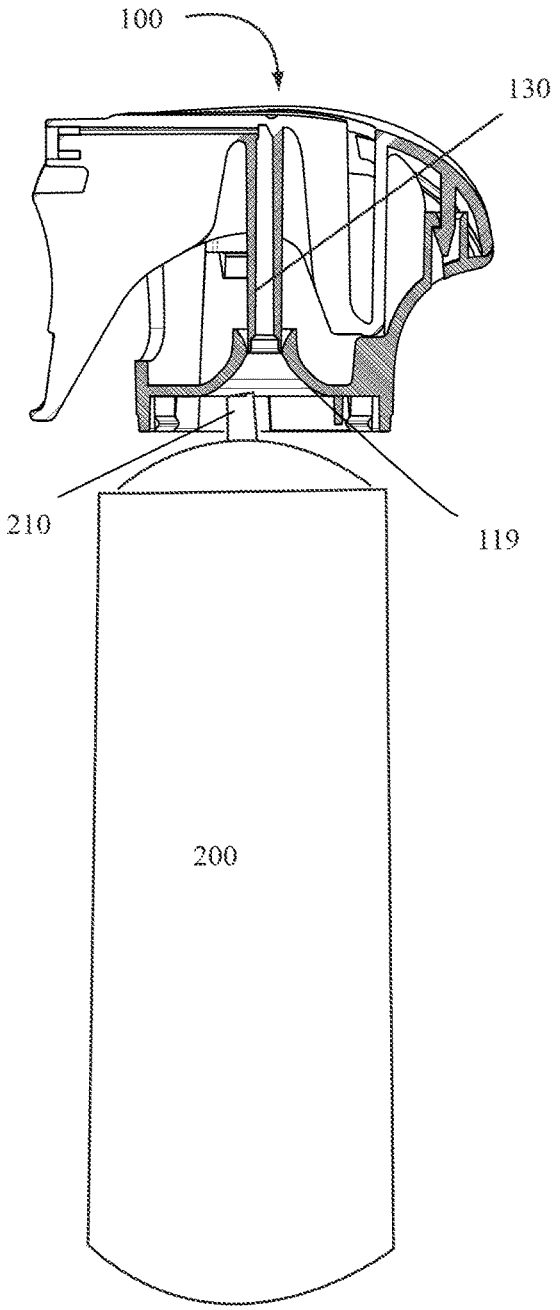
FIG. 27 illustrates an aerosol actuator according to embodiments of the invention being assembled to a container and valve.
Figure 28:
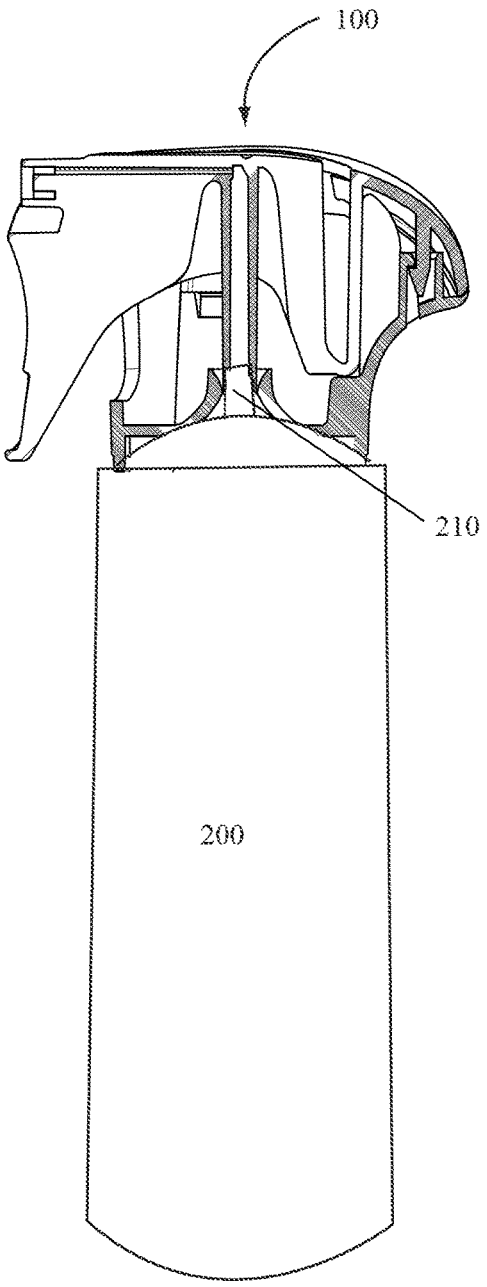
FIG. 28 illustrates an aerosol actuator according to embodiments of the invention being assembled to a container and valve.

A base 110 of an aerosol actuator 100 according to embodiments of the invention may include one or more valve guides 119 as illustrated in FIG. 22. The one or more valve guides 119 may be positioned to assist with guidance of a valve onto a manifold 130 during assembly or guidance of the manifold 130 onto a valve during assembly. For example, a container 200 having a valve 210 attached thereto may be positioned on a filling line. Assembly of an aerosol actuator 100 to the valve 210 and the container 200 may require snap fitment of the aerosol actuator 100 onto the container 200. As the aerosol actuator 100 is lowered onto the container 200, a valve 210 may not completely align with a manifold 130 to which it must be assembled. As the manifold 130 and valve 210 are mated together and assembled, the valve 210 may be twisted or angled and leakage or inadvertent actuation may occur. However, an aerosol actuator 100 having one or more valve guides 119 may improve the assembly process as the one or more valve guides 119 guide the valve 210 into the manifold 130 or the aerosol actuator 100 into a proper position in which the manifold 130 and valve 210 may be snap fit together or mated together. For example, FIGS. 27 through 28 illustrate the assembly of an aerosol actuator 100 having one or more valve guides 119 according to embodiments of the invention onto a container 200 having a valve 210.

The one or more valve guides 119 according to embodiments of the invention may be integrated with, integral to, or connected to the base 110 as illustrated in FIGS. 22 through 29. In other embodiments of the invention, the one or more valve guides 119 may be integrated with or integral to a manifold 130 or the trigger 120 portion of an aerosol actuator 100. For example, a manifold 130 may include a cone-shaped skirt extending down and outward from a manifold 130 opening such that a valve 210 may contact the cone-shaped skirt and be guided into an opening in the manifold 130 for engagement therewith.

According to various embodiments of the invention, a valve guide 119 may include a cup shape. In other embodiments, a valve guide 119 may include walls sloping to a hole through which a manifold 130 may be accessed. According to some embodiments of the invention, a valve guide 119 may include convex walls extending from a bottom of the base 110 upwards to a hole through which a manifold 130 may be accessed. In other embodiments, a valve guide 119 may include sloping walls from a bottom of a base 110 up to a hole through which a manifold 130 may be accessed. Valve guides 119 according to embodiments of the invention may also take on different shapes or may be made in different forms or shapes such that a valve 210 on a container 200 may be guided into a manifold 130 by the one or more valve guides 119.

Aerosol actuators 100 according to various embodiments of the invention may be made from moldable resin or plastic materials or other desirable materials. For example, a base 110 may be molded from any desired resin or plastic. Similarly, a trigger 120 may be molded from any desired resin or plastic. The materials used to form components of an aerosol actuator 100 according to embodiments of the invention may also include other properties and may be colored in different manners to produce different aesthetic looks. For example, a base 110 may be molded with one color and a trigger 120 molded in another color. Embodiments of the invention are not limited by the material used to make the components of an aerosol actuator 100.

Aerosol actuators 100 according to various embodiments of the invention may be attached to any type of container 200 as desired. For example, a conventional metal aerosol can may be used as a container 200 with various embodiments of the invention. In other embodiments, a plastic container 200 may be used. Also, any shaped container 200 may be used with various embodiments of the invention.

During operation of an aerosol actuator 100 connected to a container 200 according to various embodiments of the invention, a force may be applied to a trigger portion 122 of the aerosol actuator 100. The force applied to the trigger portion 122 may be resisted by the spring 126. As force is applied to the trigger portion 122, the integrated manifold 130 moves. Upon reaching a certain force, the manifold 130 may move a distance sufficient to open a valve to which the manifold 130 is attached, allowing product to flow from a container 200, through the valve and into a product flow path 132 in the manifold 130. Product may then exit the orifice 128. Upon release or decreased force upon the trigger portion 122, the spring 126 may act to return the trigger portion 122 and manifold 130 to a non-actuated state in which the valve is moved into a closed position and the flow of product through the manifold 130 ceases. Actuation of the trigger 120 may be repeated as desired.

Figure 37:
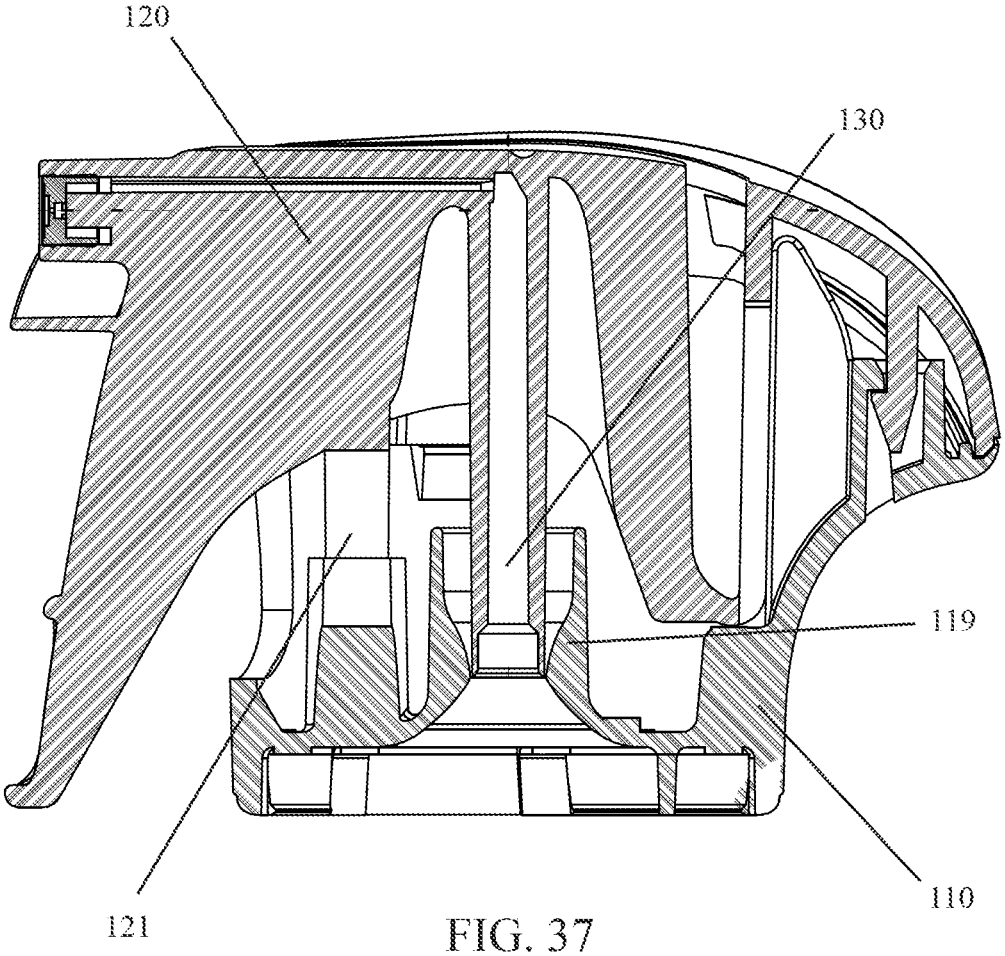
FIG. 37 illustrates a cross-sectional view of an aerosol trigger sprayer according to certain embodiments of the invention.
Figure 38:
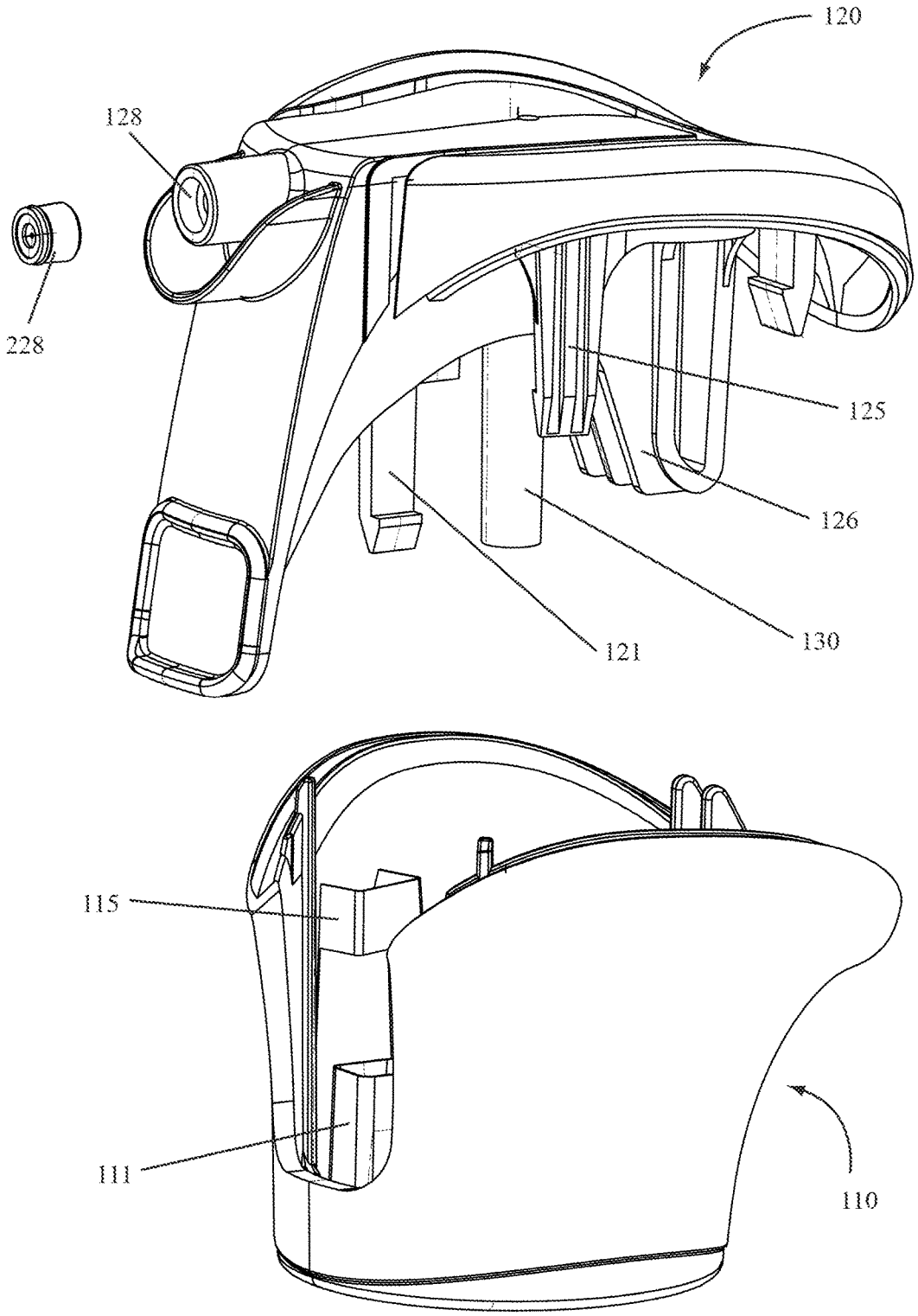
FIG. 38 illustrates an exploded view of an aerosol trigger sprayer according to certain embodiments of the invention.

An aerosol actuator 100 according to still other embodiments of the invention is illustrated in FIGS. 37 and 38. As shown in the cross-sectional view illustrated in FIG. 37, an aerosol actuator 100 may include a base 110 and a trigger 120. A spring 126 or live hinge similar to those used with other embodiments of the invention may be used. The base 110 may include one or more valve guides 119 which may be positioned to assist with guidance of a valve onto a manifold 130 during assembly or guidance of a manifold 130 onto a valve. The one or more valve guides 119 may be configured, manufactured, or otherwise used in a similar manner to the valve guides 119 according to other embodiments of the invention.

According to some embodiments of the invention, a valve guide 119 may extend into an interior of the base 110 and around a manifold 130 when assembled with a trigger 120. The height of a valve guide 119 may be selected or designed to improve the fitment of the manifold within the valve guide 119 or to decrease the likelihood that a manifold 130 will pull out of the valve guide 119 during operation. For example, as illustrated in FIG. 37, a valve guide 119 may extend along a manifold 130 such that it is unlikely that the manifold 130 could pop out of or become dislodged from within the valve guide 119 during operation of the aerosol actuator 100.

An aerosol actuator 100 according to embodiments of the invention may also include one or more trigger latches 121 as illustrated in FIG. 38 which may mate with one or more trigger snap fitments 111. The one or more trigger latches 121 and trigger snap fitments 111 may be formed integrally with, or molded with, a trigger 120 or base 110 as desired. One or more trigger latches 121 may be included in addition to any snap attachments 125 and snap fitments 115.

An orifice cup 228 may be fitted into an orifice 128 as desired.

According to various embodiments of the invention, an aerosol trigger sprayer may include two or more parts. According to some embodiments, an aerosol trigger sprayer may include a body including an integrally molded manifold and actuator post. A trigger and cap piece may mate with or attach to the body and may include an integrally formed trigger which may interact with the actuator post of the body. One or more living hinges molded or designed in the trigger and body may allow the trigger to be actuated such that the trigger flexes the actuator post which in turn moves the manifold and opens a valve allowing a product to flow from a container, through the valve, through the manifold and out an orifice.

Figure 29:
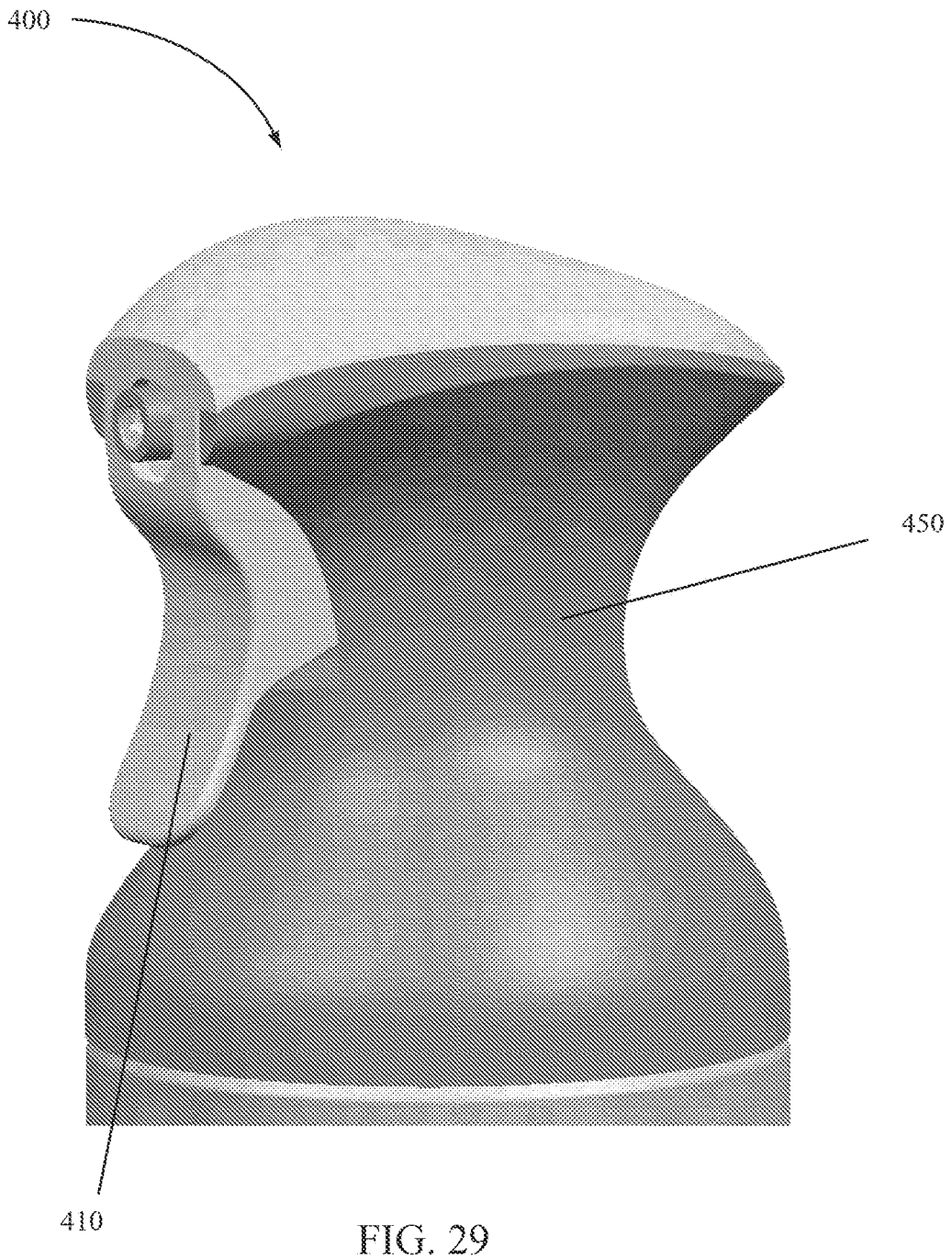
FIG. 29 illustrates an aerosol trigger sprayer according to embodiments of the invention.
Figure 30:
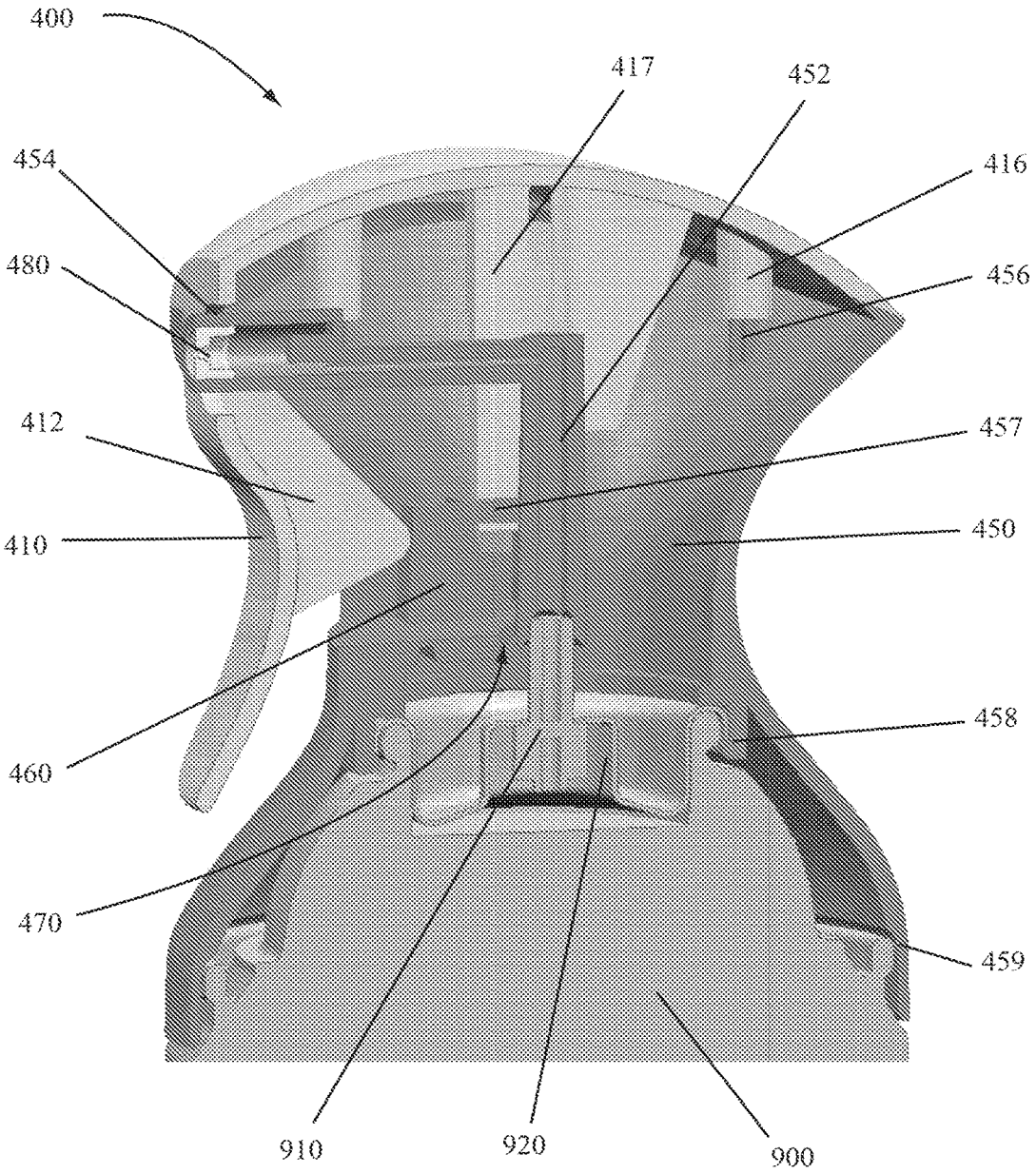
FIG. 30 illustrates a cross-sectional view of an aerosol trigger sprayer according to certain embodiments of the invention.

Aerosol trigger sprayers according to various embodiments of the invention are illustrated in FIGS. 29 through 34. An aerosol trigger sprayer 400 according to various embodiments of the invention is illustrated in FIG. 29. An aerosol trigger sprayer 400 may include a trigger 410 and a body 450. The trigger 410 may be integrated with, or part of, a cap which attaches to, or may be connected to, the body 450. In various embodiments of the invention, one or more living hinges associated with the trigger 410, the body 450, or both the trigger 410 and the body 450 may FIG. 30 illustrates a cross-sectional view of an aerosol trigger sprayer 400 according to certain embodiments of the invention. A trigger 410 is connected to, or attached to, a body 450. The body 450 may include one or more posts 456 which mate with, snap into, or rest in one or more post retainers 416 of the trigger 410. Alternatively, the trigger 410 may include posts and the body 450 may include post retainers as needed. The trigger 410 may also include one or more snap fitments 417 arranged to snap into and retain the trigger 410 with the body 450. The one or more snap fitments 417 may snap into one or more retainers 457 integrated with the body. Alternatively, the snap fitments may be part of the body 450 and the retainers part of the trigger 410.

According to embodiments of the invention, a body 450 of an aerosol trigger sprayer 400 may include an integrated manifold 452 and actuator post 460. A manifold 452 may be molded with the body 450 such that the desired manifold 452 characteristics are achieved. For example, the manifold 452 may include a shape or configuration to fit with a particular valve size or configuration as needed. An actuator post 460 may be connected to the manifold 452 by one or more living hinges 470. The body 450 may also include a discharge chamber 454 as part of the manifold 452. The discharge chamber 454 may include an orifice 480 integrally molded therewith or inserted into a portion of the discharge chamber 454. An orifice 480, whether inserted into the discharge chamber 454 or molded with the manifold 452, may provide desired spin mechanics for the aerosol trigger sprayer 400.

According to embodiments of the invention, the trigger 410 may include a trigger post 412 attached thereto or molded therewith. The trigger post 412 may be configured to contact the actuator post 460 of the body 450 when the trigger 410 is actuated. The trigger 410 may also include one or more living hinges allowing a portion of the trigger 410 to flex when a force is applied to the trigger 410.

In some embodiments of the invention, an aerosol trigger sprayer 400 may be connected to a container 900 containing a product, such as an aerosol product. One or more portions of the body 450 may snap onto a container 900 or onto a valve cap 920 connected to a container 900 as illustrated in FIG. 30. A valve 910 fitted to the valve cap 920 and container 900 may mate with, or be in communication with, a portion of the manifold 452. For example, aerosol trigger sprayers 400 according to embodiments of the invention may be connected to conventional aerosol containers using conventional valve systems. The body 450 of an aerosol trigger sprayer 400 may include a snap fit latch 458 which may snap around or connect to a rim of a container 900 or valve cap 920. The body 450 may also include a lip 459 or snap fitment to rest on or attach to a rim on a container.

Figure 31:
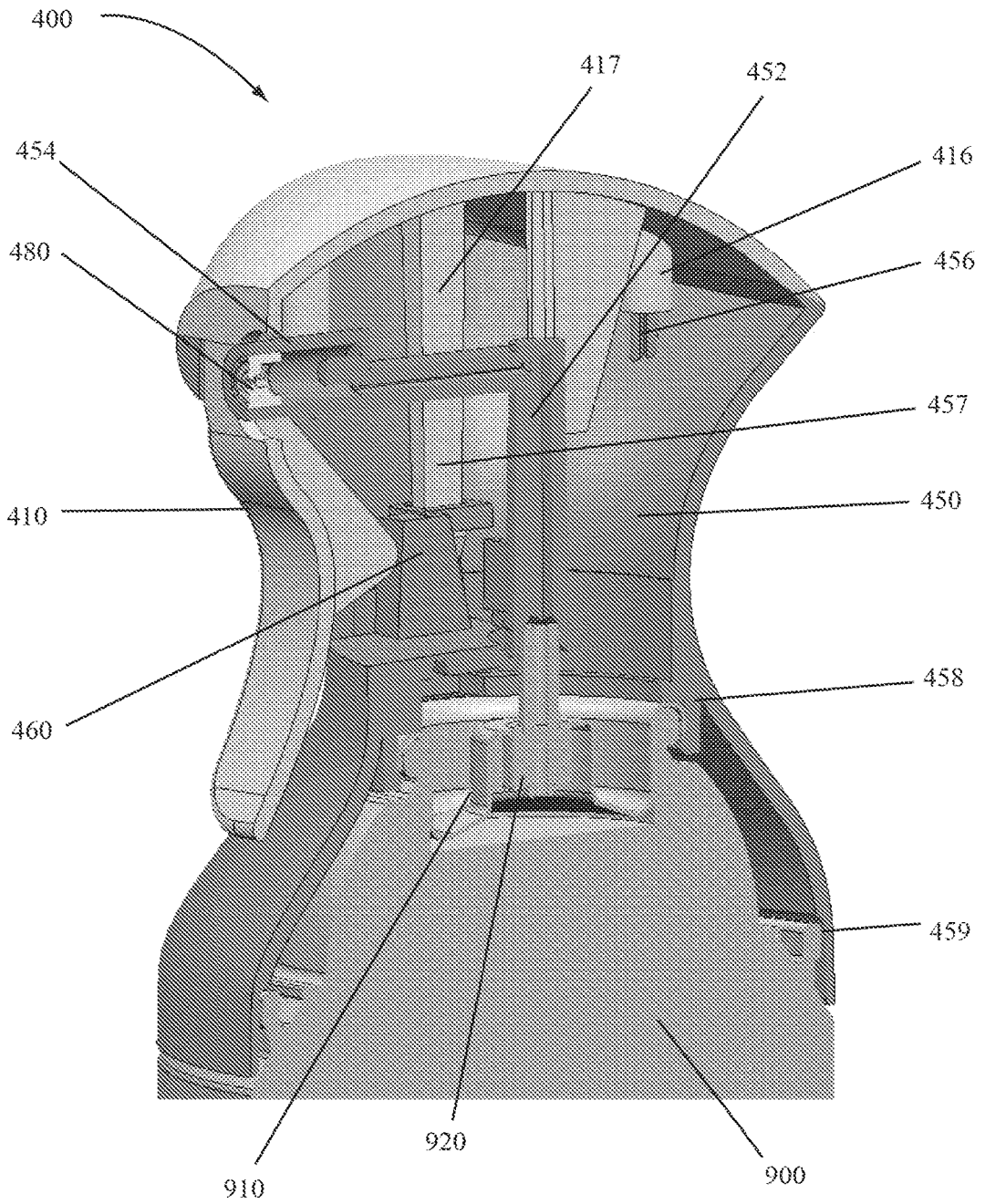
FIG. 31 illustrates a cross-sectional view of an aerosol trigger sprayer according to certain embodiments of the invention.

An alternative view of an aerosol trigger sprayer 400 according to various embodiments of the invention is illustrated in FIG. 31.

Figure 32:
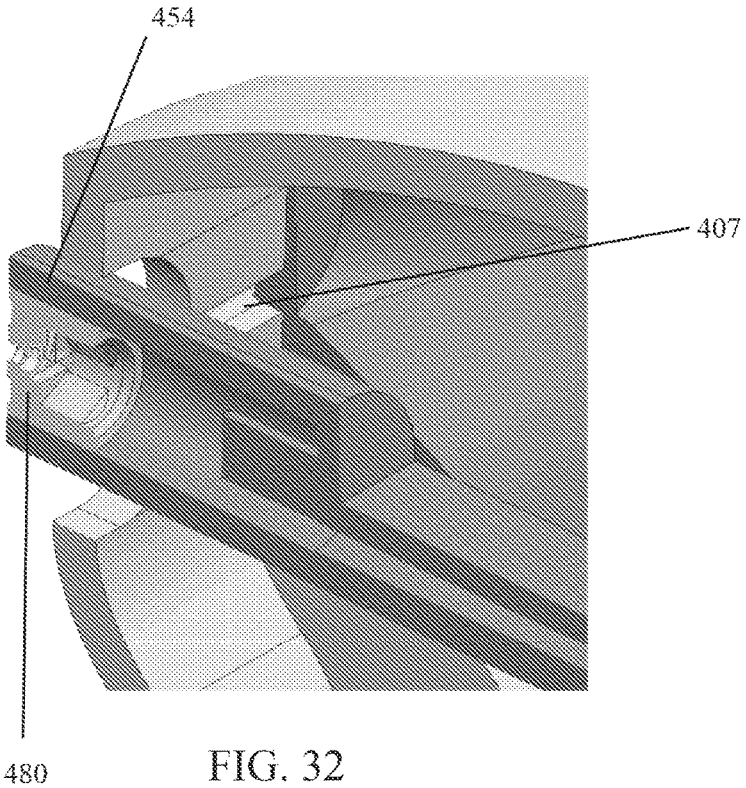
FIG. 32 illustrates a blown-up view of a living hinge incorporated with an aerosol trigger sprayer according to various embodiments of the invention.

According to various embodiments of the invention, one or more living hinges may be formed in the trigger 410 to allow a portion of the trigger 410 to flex or move when a force is applied to that portion of the trigger 410. As illustrated in FIG. 32, a trigger 410 may include a trigger living hinge 407 around an opening through which a portion of the manifold 452 or discharge chamber 454 extends. The trigger living hinge 407 may allow a trigger portion of the trigger 410 to flex when the trigger 410 is actuated. Upon a release of force on the trigger 410, the trigger living hinge 407 may allow or facilitate trigger 410 return to a non-actuated position. While FIG. 32 illustrates one side of a trigger living hinge 407 in the cross-sectional view, it is understood that the trigger living hinge 407 may extend on the other side of the trigger 410 as well. Further, placement of a trigger living hinge 407 is not limited to the placement illustrated in FIG. 32. It is understood that one or more trigger living hinges 407 may be integrated with the trigger 410 to allow the trigger 410 to flex and actuate an aerosol trigger sprayer 400 according to embodiments of the invention.

Figure 33:
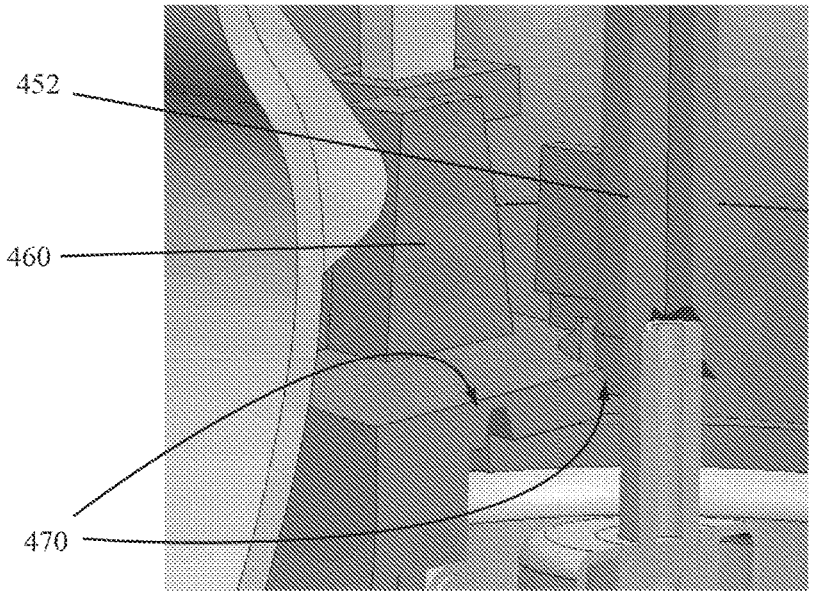
FIG. 33 illustrates a blown-up view of living hinges incorporated with an aerosol trigger sprayer according to embodiments of the invention.

As a trigger 410 is actuated and a trigger living hinge 407 flexes, the trigger post 412 may contact or interact with an actuator post 460 of the body 450. One or more living hinges 470 on the body 450 may flex as a force is applied to the actuator post 460. A living hinge 470 between the actuator post 460 and the manifold 452 may flex and push or pull the manifold 452 in a downward motion. At the same time, a second living hinge 470 may open allowing the actuator post 460 to move. As the actuator post 460 flexes the one or more living hinges 470 and moves the manifold 452, the manifold 452 may press on a valve 910 and open the valve 910, releasing product from a container 900 through the valve 910 and through the manifold 452. FIG. 33 illustrates a living hinge 470 configuration according to one embodiment of the invention. While the living hinges 470 illustrated in FIG. 33 may be used with embodiments of the invention, other configurations of one or more living hinges 470 may be used to facilitate actuation of a manifold 452 with a valve 910.

Figure 34:
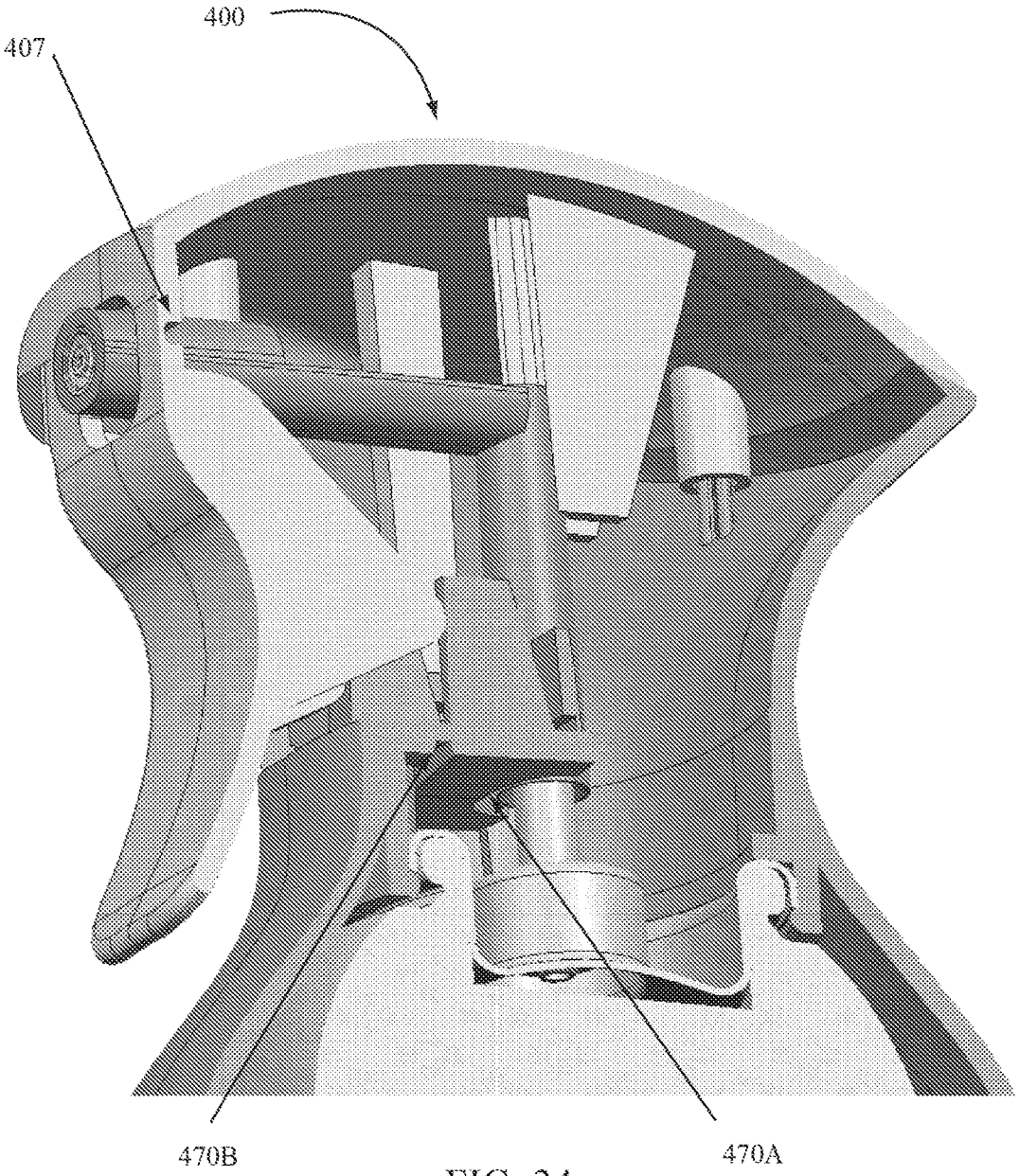
FIG. 34 illustrates a cross-sectional view of an aerosol trigger sprayer according to certain embodiments of the invention.

FIG. 34 illustrates an aerosol trigger sprayer 400 according to embodiments of the invention. As illustrated, the trigger 410 may include a single trigger living hinge 407 and the body may include a manifold living hinge 470A and an actuator post living hinge 470B. As a force is applied to the trigger 410, a portion of the trigger 410 below the trigger living hinge 407 flexes and applies a force to the actuator post 460. The actuator post 460, in turn, flexes about the actuator post living hinge 470B and applies force to the manifold living hinge 470A which pushes or pulls the manifold 452 down onto a valve 910, opening the valve and releasing product from a container 900 through the valve 910 and into the manifold 452. When the force on the trigger 410 is released, the trigger living hinge 407 moves the trigger 410 back into a non-actuated position and the living hinges 470A and 470B move the actuator post 460 into a non-actuated position, relieving the force on the manifold 452 and closing the valve 910.

Figure 35:
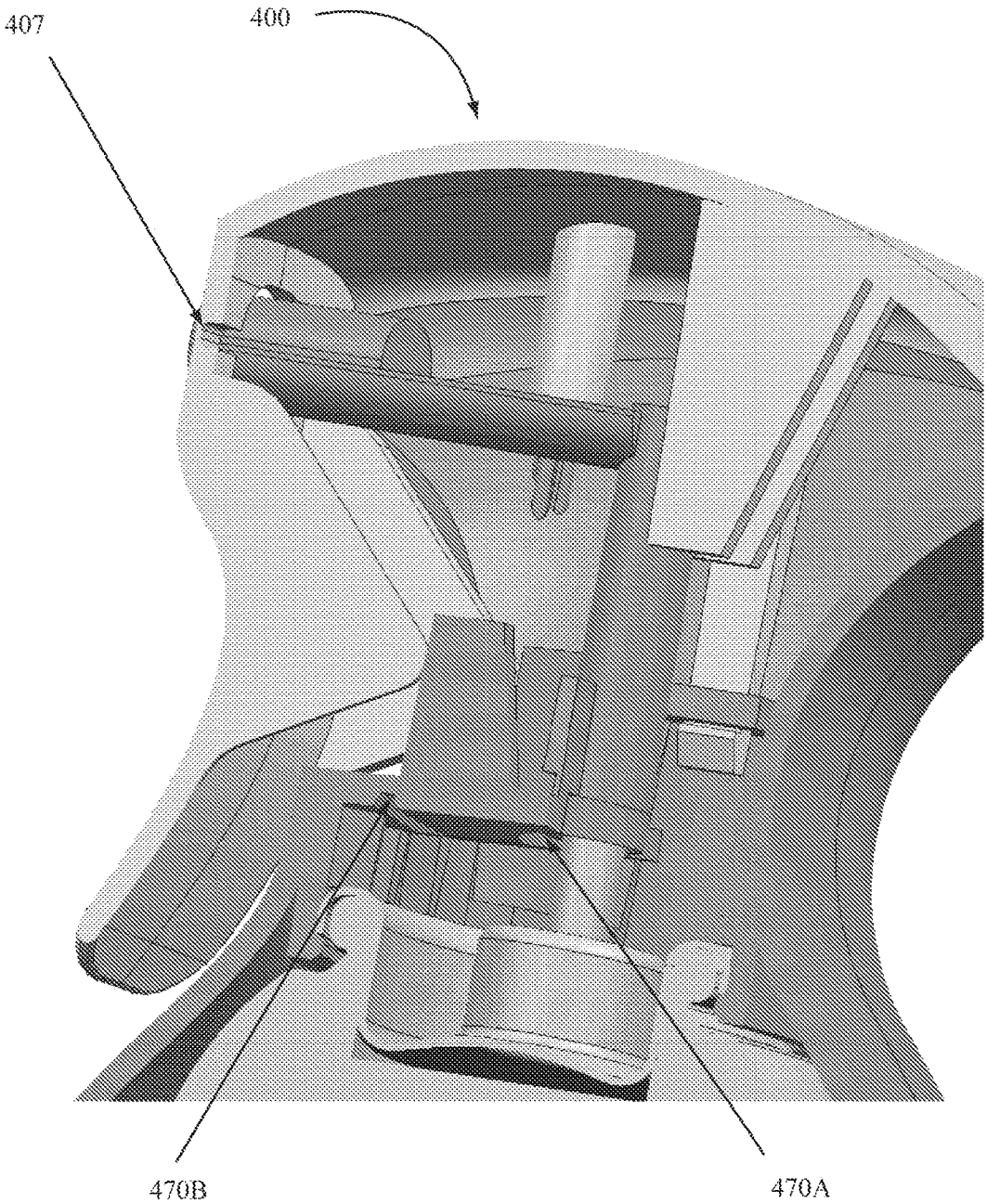
FIG. 35 illustrates a cross-sectional view of an aerosol trigger sprayer according to certain embodiments of the invention.

FIG. 35 illustrates a different perspective of the trigger living hinge 407 and the body 450 living hinges 470 according to various embodiments of the invention.

According to embodiments of the invention, the trigger 410 and body 450 of an aerosol trigger sprayer 400 may be molded from plastic or other resin material. The trigger 410 may be molded as a single piece and the body 450 may be molded as a single piece. The trigger 410 and body 450 may be assembled together and then assembled on a container 900 as known. Thus, in some embodiments, a two-piece aerosol trigger actuator 400 may be made. In other embodiments, an orifice 480 or orifice cup may be inserted into a discharge chamber 454 such that an aerosol trigger actuator 400 includes three parts.

Figure 36A:
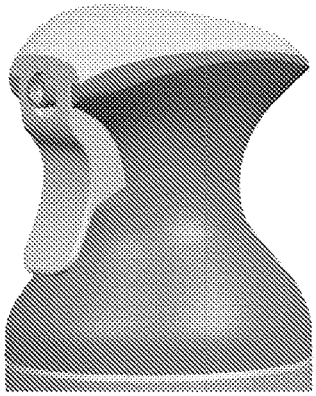
FIGS. 36A-36F illustrate an aesthetic design of an exterior of an aerosol trigger sprayer according to one embodiment of the invention.
Figure 36B:
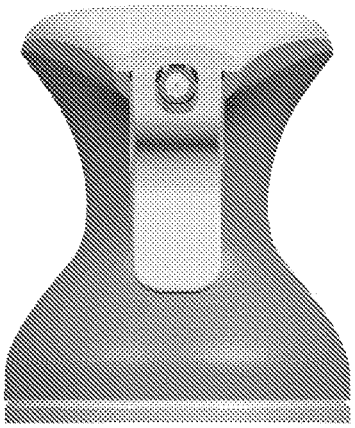
Figure 36C:
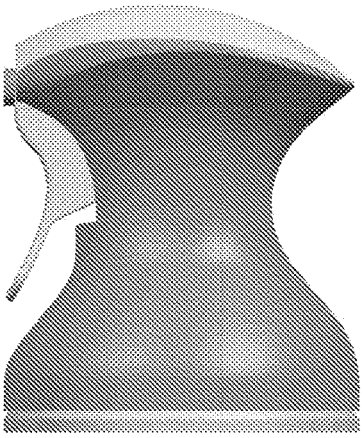
Figure 36D:
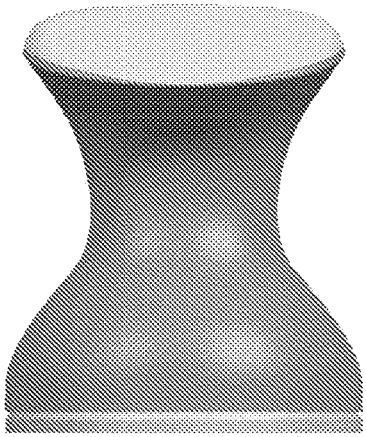
Figure 36E:
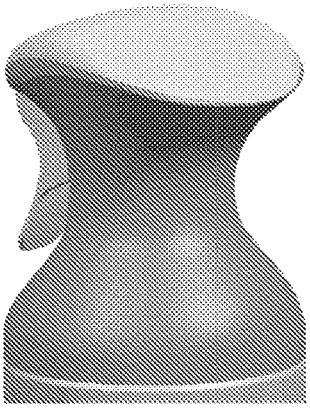
Figure 36F:
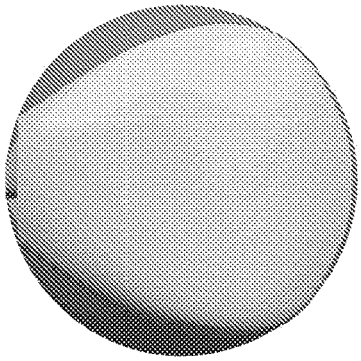

According to embodiments of the invention, the trigger 410 and body 450 of an aerosol trigger sprayer 400 may be molded or configured in any desired shape. An example of an aesthetic of an aerosol trigger sprayer 400 according to one embodiment of the invention is illustrated in FIGS. 36A through 36F, wherein, FIG. 36A illustrates a perspective view of the design, FIG. 36B illustrates a front view of the design, FIG. 36C illustrates a side view of the design, FIG. 36D illustrates a rear view of the design, FIG. 36E illustrates a rear perspective view of the design, and FIG. 36F illustrates a top view of the design.

Having thus described certain particular embodiments of the invention, it is understood that the invention defined by the appended claims is not to be limited by particular details set forth in the above description, as many apparent variations thereof are contemplated. Rather, the invention is limited only be the appended claims, which include within their scope all equivalent devices or methods which operate according to the principles of the invention as described.

What is claimed is:

1. An aerosol actuator, comprising:

a base, comprising at least one valve guide sloping from an opening at a bottom of the base to a narrow hole; and a trigger, comprising:

a cap portion;

a trigger portion; and a manifold integrally formed with the trigger portion and having an end seated in the narrow hole of the valve guide.

2. The aerosol actuator of claim 1, wherein the trigger further comprises an orifice.

3. The aerosol actuator of claim 1, wherein the trigger further comprises a cup.

4. The aerosol actuator of claim 1, wherein the trigger further comprises a spring integrated with the trigger and in communication with the trigger portion.

5. The aerosol actuator of claim 1, wherein the base and the trigger are made of a material selected from the group consisting of resin and plastic.

6. The aerosol actuator of claim 1, further comprising an orifice cup.

7. An aerosol package, comprising:

a container;

an aerosol actuator connected to the container, comprising:

a base comprising at least one valve guide having an opening at a bottom of the base and a wall sloping inward from the opening to a narrow hole further from the bottom of the base; and a trigger, comprising:

a cap portion;

a spring integrated in the cap portion;

a trigger portion in communication with the spring; and a manifold integrated with the trigger portion.

8. The aerosol package of claim 7, wherein the container comprises a container selected from the group consisting of a metal container and a plastic container.

9. The aerosol package of claim 7, wherein the aerosol actuator comprises an aerosol actuator made from at least one material selected from the group consisting of resin and plastic.

10. The aerosol package of claim 7, wherein the at least one valve guide further comprises a cup.

11. The aerosol package of claim 7, wherein the at least one valve guide further comprises convex walls and a manifold opening at the narrow hole, wherein an end of the manifold is seated in the manifold opening.

12. An aerosol actuator, comprising:

a base, comprising:

at least one container connection adjacent a lower portion of the base;

a valve guide positioned above the at least one container connection, wherein the valve guide comprises a wall sloping from an opening near a bottom of the base to a narrow hole further away from the bottom of the base; and at least one snap fitment adjacent an upper portion of the base;

a trigger attached to the base, comprising:

a cap portion;

at least one snap attachment extending downward from the cap portion and snap-fit to the at least one snap fitment of the base;

a trigger portion extending from the cap portion;

a living hinge in the cap portion and connected to the trigger portion; and a manifold, wherein an end of the manifold is seated in the narrow hole of the valve guide.

13. The aerosol actuator of claim 12, wherein the wall of the valve guide comprises a convex wall sloping from the opening to the narrow hole.

14. The aerosol actuator of claim 12, wherein the wall of the valve guide is cup shaped.

* * * * *